US008347826B2

(12) United States Patent
Amada

(10) Patent No.: US 8,347,826 B2
(45) Date of Patent: Jan. 8, 2013

(54) HEAT EXCHANGER, WATER HEATER AND WATER TUBE

(75) Inventor: Keiichi Amada, Hyogo (JP)

(73) Assignee: Noritz Corporation, Hyogo (JP)

( * ) Notice: Subject to any disclaimer, the term of this patent is extended or adjusted under 35 U.S.C. 154(b) by 1092 days.

(21) Appl. No.: 12/269,436

(22) Filed: Nov. 12, 2008

(65) Prior Publication Data

US 2009/0064945 A1 Mar. 12, 2009

Related U.S. Application Data

(63) Continuation-in-part of application No. 11/806,319, filed on May 31, 2007, now abandoned.

(30) Foreign Application Priority Data

Jun. 16, 2006 (JP) ..... 2006-168023

(51) Int. Cl.
*F28F 1/36* (2006.01)

(52) U.S. Cl. ..... 122/31.1; 122/235.23; 165/184

(58) Field of Classification Search ..... 122/13.01, 122/19.2, 31.1, 235.14, 235.23, 235.19, 244, 122/247, 248, 249, 265; 165/157, 184, 177, 165/181, 183

See application file for complete search history.

(56) References Cited

U.S. PATENT DOCUMENTS

| | | | | |
|---|---|---|---|---|
| 528,388 | A | 10/1894 | Phillips | |
| 541,867 | A | 7/1895 | Martin et al. | |
| 3,868,927 | A | 3/1975 | Losel et al. | |
| 6,237,545 | B1 | 5/2001 | Barnett et al. | |
| 6,427,638 | B1 | 8/2002 | Kolbusz et al. | |
| 7,458,340 | B2 * | 12/2008 | Takeda et al. | 122/31.1 |
| 7,647,897 | B2 * | 1/2010 | Ootomo et al. | 122/33 |
| 2001/0047773 | A1 | 12/2001 | Woodford | |

FOREIGN PATENT DOCUMENTS

| | | | |
|---|---|---|---|
| JP | 62-288446 | A | 12/1987 |
| JP | 06-008442 | Y2 | 3/1994 |
| JP | 2835286 | B2 | 10/1998 |

* cited by examiner

*Primary Examiner* — Gregory A Wilson

(74) *Attorney, Agent, or Firm* — Rader, Fishman & Grauer PLLC

(57) ABSTRACT

A water tube WT of a heat exchanger B includes a helical tube body 5 which includes a plurality of loops 50 arranged in the axial direction. At least one of the loops 50 includes an inclined tube portion which is inclined with respect to the axial direction and a non-inclined tube portion extending perpendicularly to the axial direction. The inclined tube portion is provided at each of opposite end regions s2*a* and s2*b* in a width direction crossing the axial direction, whereas the non-inclined tube portion is provided at an intermediate region S1 in the width direction. With this structure, the pitch p2 of the loops 50 is reduced. Therefore, by increasing the number of loops 50, high heat exchange efficiency is achieved without considerably increasing the size of the helical tube body 5.

6 Claims, 8 Drawing Sheets

HEAT EXCHANGER, WATER HEATER AND WATER TUBE

RELATED APPLICATIONS

This is a Continuation-In-Part Application of application Ser. No. 11/806,319 filed on May 31, 2007, and claims the foreign priority benefits of the parent application stated therein to the extent possible.

TECHNICAL FIELD

The present invention relates to a heat exchanger for recovering heat from combustion gas by utilizing a water tube including a helical tube body to produce hot water. The invention also relates to a water heater provided with such a heat exchanger, and a water tube for a heat exchanger.

BACKGROUND ART

Examples of conventional heat exchanger are disclosed in Japanese Patent No. 2835286, Japanese laid-open patent publication No. 62-288446 and Japanese examined utility model publication No. 6-8442. In the heat exchanger disclosed in these documents, a helical tube body of a water tube is accommodated in a casing into which combustion gas is to be introduced. Heat is recovered from the combustion gas by the helical tube body, so that water supplied into the water tube is heated. As compared with a straight tube body, such a helical tube body has a larger heat transfer area. Therefore, with the heat exchanger, the amount of heat recovery can be increased while the number of water tubes is reduced.

However, the above-described conventional structure has the following problems.

As schematically shown in FIG. 9, the helical tube body 9 of the water tube of the conventional structure includes a plurality of loops 90 continuously connected to each other and arranged in the axial direction (the direction in which the central axis of the helical tube body 9 extends). Each of the loops 30 is inclined at a predetermined angle • throughout the entire length thereof. With this structure, the height h1 of a half region of one loop 90 is given by h1=L• tan •, and the pitch p1 of the helical tube body 9 is given by p1=2•h1=2•L• tan •, where L is the diameter or width of the helical tube body 9. Thus, the pitch p1 is relatively large. To increase the amount of heat to be recovered by the water tube, the number of loops 90 needs to be increased. However, since the dimensions h1 and p1 are relatively large, the overall height h of the helical tube body 9 becomes considerably large when the number of loops 90 is increased. Thus, the conventional structure has a drawback that the overall height of the helical tube body 9 becomes considerably large when the number of loops 90 is increased to increase the amount of heat recovery.

In cold season, for example, the use of a water heater provided with a heat exchanger may be stopped for a long time. In such a case, to prevent the inside of the water tube from freezing, draining of water from the water tube may be performed. Therefore, it is desired that the above-described problem as to the height increase is solved without making the draining of the water tube difficult.

DISCLOSURE OF THE INVENTION

An object of the present invention is to solve or alleviate the above-described problems.

To achieve the object, the present invention takes the following technical measures.

According to a first aspect of the present invention, there is provided a heat exchanger comprising a casing into which combustion gas is to be introduced, and a water tube for recovering heat from the combustion gas. The water tube is accommodated in the casing and includes a helical tube body which includes a plurality of loops arranged in the axial direction and continuously connected to each other. At least one of the loops includes an inclined tube portion which is inclined with respect to the axial direction and a non-inclined tube portion extending perpendicularly to the axial direction. The inclined tube portion is provided at each of opposite end regions in a width direction crossing the axial direction, whereas the non-inclined tube portion is provided at an intermediate region in the width direction.

Preferably, all of the loops include the inclined tube portion and the non-inclined tube portion.

Preferably, each of the loops includes a pair of straight tube portions extending in the width direction and substantially in parallel with each other, and a pair of bent tube portions connected to ends of the straight tube portions. Each of the straight tube portions is the non-inclined tube portion, whereas each of the bent tube portions is the inclined tube portion.

Preferably, the helical tube body is so disposed in the casing that the loops are arranged vertically, and the casing includes a pair of walls sandwiching the helical tube body in the horizontal direction. The paired walls are formed with a gas supply port and a gas discharge port, respectively, and combustion gas introduced into the casing through the gas supply port flows through a gap between adjacent ones of the loops and is discharged from the casing through the gas discharge port.

Preferably, the water tube includes an extension connected to a lower end of the helical tube body, and part of the extension is positioned outside the casing. This extension extends through a side wall.

This part is provided with a bent portion which is so bent as to reduce the height thereof as extending toward an end of the extension.

According to a second aspect of the present invention, there is provided a water heater comprising a burner and a heat exchanger. The heat exchanger comprises a casing into which combustion gas is to be introduced, and a water tube for recovering heat from the combustion gas. The water tube is accommodated in the casing and includes a helical tube body which includes a plurality of loops arranged in the axial direction and continuously connected to each other. At least one of the loops includes an inclined tube portion which is inclined with respect to the axial direction and a non-inclined tube portion extending perpendicularly to the axial direction. The inclined tube portion is provided at each of opposite end regions in a width direction crossing the axial direction, whereas the non-inclined tube portion is provided at an intermediate region in the width direction.

According to a third aspect of the present invention, there is provided a water tube for a heat exchanger. The water tube comprises a helical tube body which includes a plurality of loops arranged in the axial direction and continuously connected to each other. At least one of the loops includes an inclined tube portion which is inclined with respect to the axial direction and a non-inclined tube portion extending perpendicularly to the axial direction. The inclined tube portion is provided at each of opposite end regions in a width direction crossing the axial direction, whereas the non-inclined tube portion is provided at an intermediate region in the width direction.

Other features and advantages of the present invention will become more apparent from description of the embodiments given below with reference to the accompanying drawings.

BRIEF DESCRIPTION OF THE DRAWINGS

FIG. 5A is a horizontal sectional view of a secondary heat exchanger of the water heater shown in FIG. 1, whereas

FIG. 6A is a plan view showing an example of water tube of the secondary heat exchanger shown in FIGS. 5A and 5B, whereas

BEST MODE FOR CARRYING OUT THE INVENTION

Preferred embodiments of the present invention will be described below with reference to the accompanying drawings.

FIGS. 1-6 show an example of water heater and the related structure according to the present invention. In these figures, the arrow V indicates the vertical direction, whereas the arrow H indicates the horizontal direction.

Figure 1:
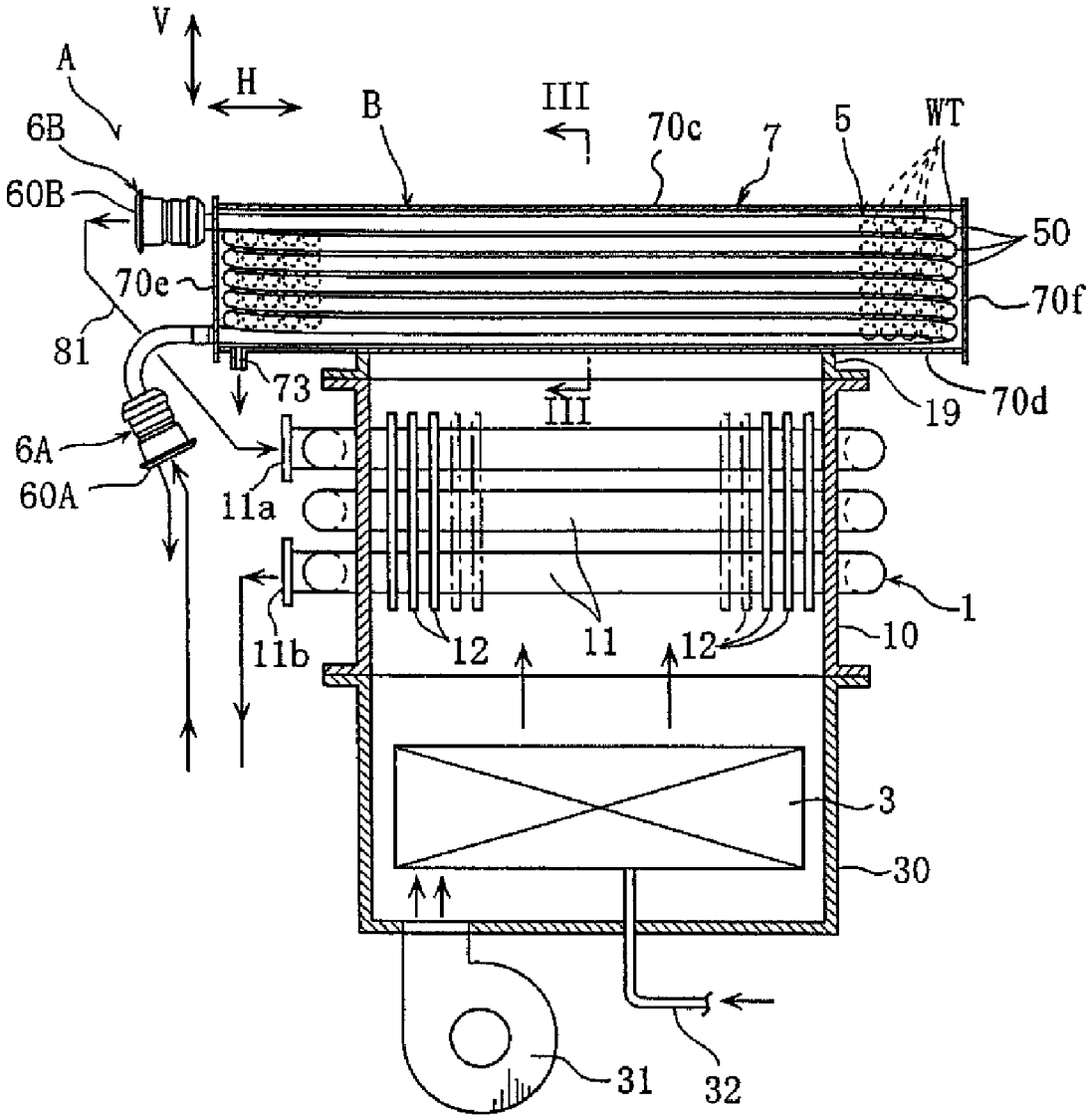
FIG. 1 is a front sectional view schematically showing an example of water heater according to the present invention.

As better shown in FIG. 1, the water heater A of this embodiment includes a burner 3, a primary heat exchanger 1 and a secondary heat exchanger B. The secondary heat exchanger B is an example of heat exchanger to which the present invention is applied.

The burner 3 is arranged in a casing 30 and burns gas supplied from the outside of the casing 30 through a pipe 32. A fan 31 is arranged below the casing 30 so that air for combustion is supplied from the fan 31 upward into the casing 30. The primary heat exchanger 1 is provided for recovering sensible heat from the combustion gas generated by the burner 3. The primary heat exchanger 1 includes a water tube 11 provided with a plurality of fins 12 and penetrating through a casing 10 generally horizontally. The casings 10 and 30 may be formed integrally with each other.

Figure 2:
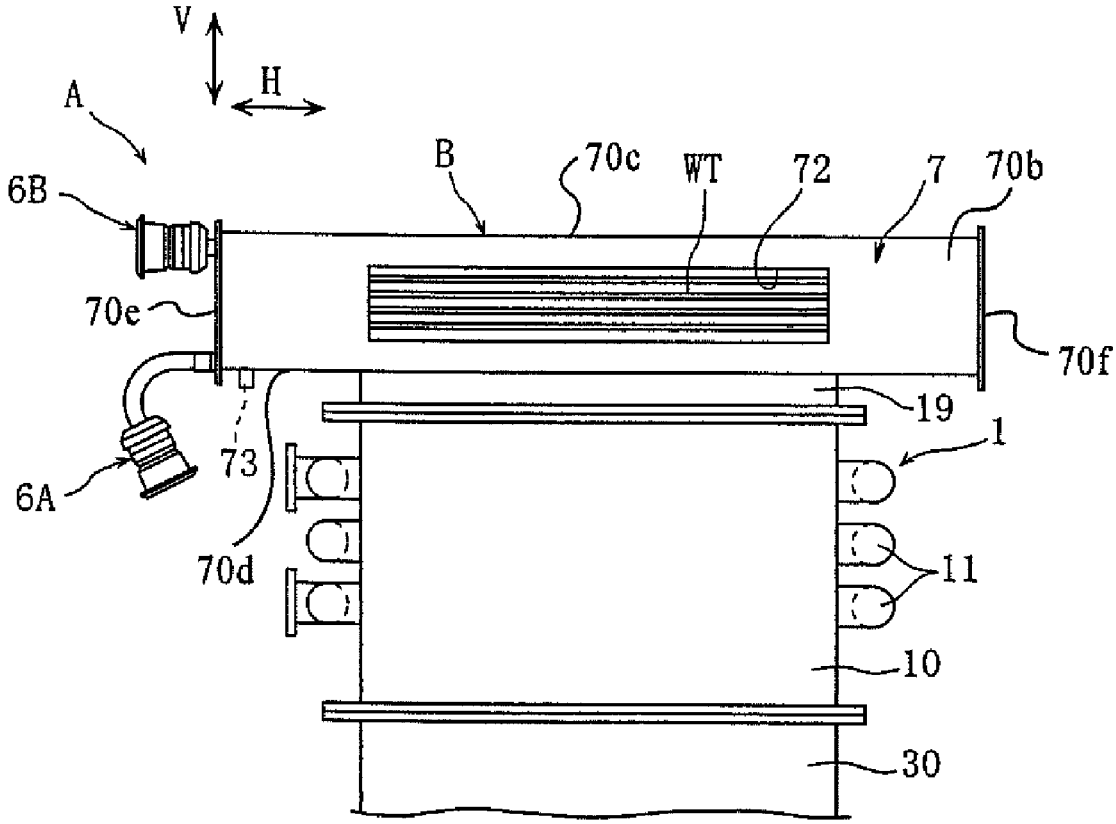
FIG. 2 is a front view of a principal portion of the water heater shown in FIG. 1.
Figure 3:
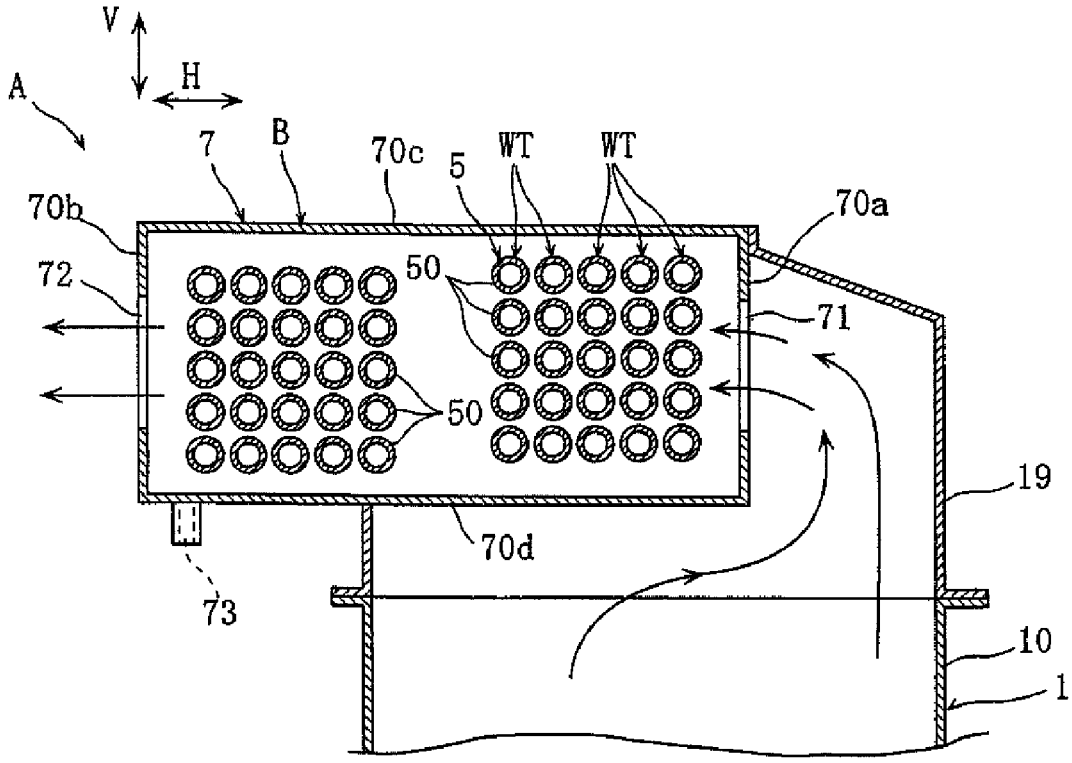
FIG. 3 is a sectional view taken along lines III-III in FIG. 1.
Figure 4:
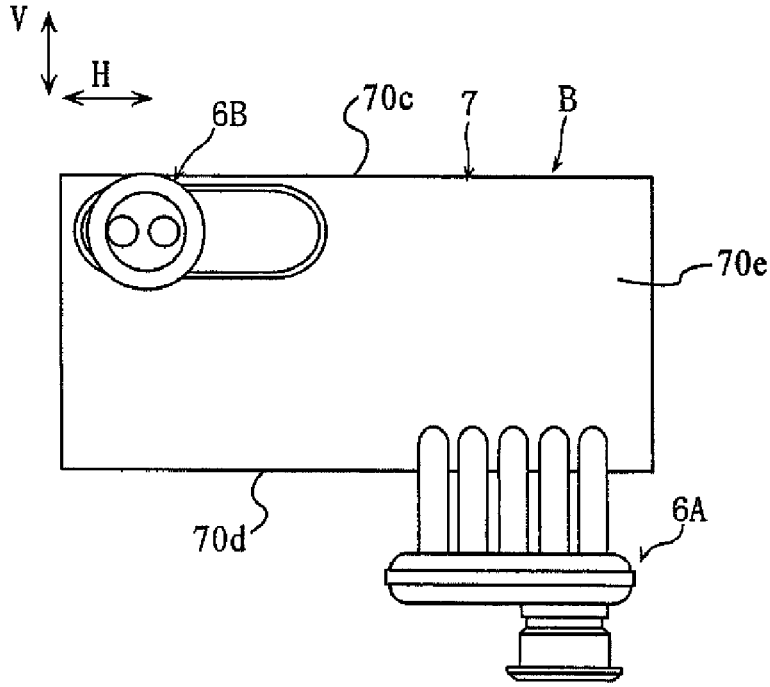
FIG. 4 is a side view of a principal portion of the water heater shown in FIG. 1.

The secondary heat exchanger B is provided for recovering latent heat from the combustion gas. The secondary heat exchanger B is arranged above the primary heat exchanger 1 and connected to the casing 10 via an auxiliary casing 19. The secondary heat exchanger B includes a casing 7 into which combustion gas is to be introduced, a plurality of water tubes WT each including a helical tube body 5, and headers 6A and 6B for water inflow and hot-water outflow. As shown in FIGS. 1-5B, the casing 7 has a horizontally-extending upper wall 70*c* and a horizontally-extending opposing bottom wall 70*d*, a first pair of vertically-extending opposing side walls in a form of a rear wall 70*a* and a front wall 70*b* (FIG. 3) and a second pair of vertically-extending opposing side walls in a form of a side wall 70*e* and another side wall 70*f*. In FIGS. 1-5B, the upper wall 70*c*, the bottom wall 70*d*, the rear wall 70*a*, the bottom wall 70*d*, the side wall 70*e* and the another side wall 70*f* are connected together to form a hexahedron configuration, i.e. configured as a box. In FIG. 3, the rear wall 70*a* (i.e., one of the first pair of opposing side walls) has a gas supply port 71 that extends through the rear wall 70*a*. Also, in FIG. 3, the front wall 70*b* (i.e. a remaining one of the first pair of opposing side walls) having a gas discharge port 72 extending through the front wall 70*b*. Note in FIG. 3, the gas discharge port 72 faces the gas supply port 71.

The casing 7 is in the form of a generally rectangular parallelepiped and encloses the helical tube bodies 5. As mentioned above and shown in FIG. 3, the casing 7 includes the rear wall 70*a* and the front wall 70*b* which are formed with the gas supply port 71 and the gas discharge port 72, respectively. The gas discharge port 72 may have a generally rectangular shape as shown in FIG. 2, and the gas supply port 71 may have a similar shape. The combustion gas passed through the primary heat exchanger 1 and flowed upward enters the casing 7 through the gas supply port 71. In the casing 7, the water tubes WT recover latent heat from the combustion gas. After the latent heat recovery, the combustion gas is discharged from the casing 7 through the gas discharge port 72. When latent heat is recovered from the combustion gas, condensate water is generated at the surfaces of the water tubes WT. Therefore, a discharge port 73 for discharging condensate water is provided at the bottom wall 70*d* of the casing 7. With this structure, when condensate water drops from the surfaces of the water tubes WT onto the bottom wall 70*d* of the casing 7, the condensate water is discharged from the casing 7 through the discharge port 73.

Figure 5A:
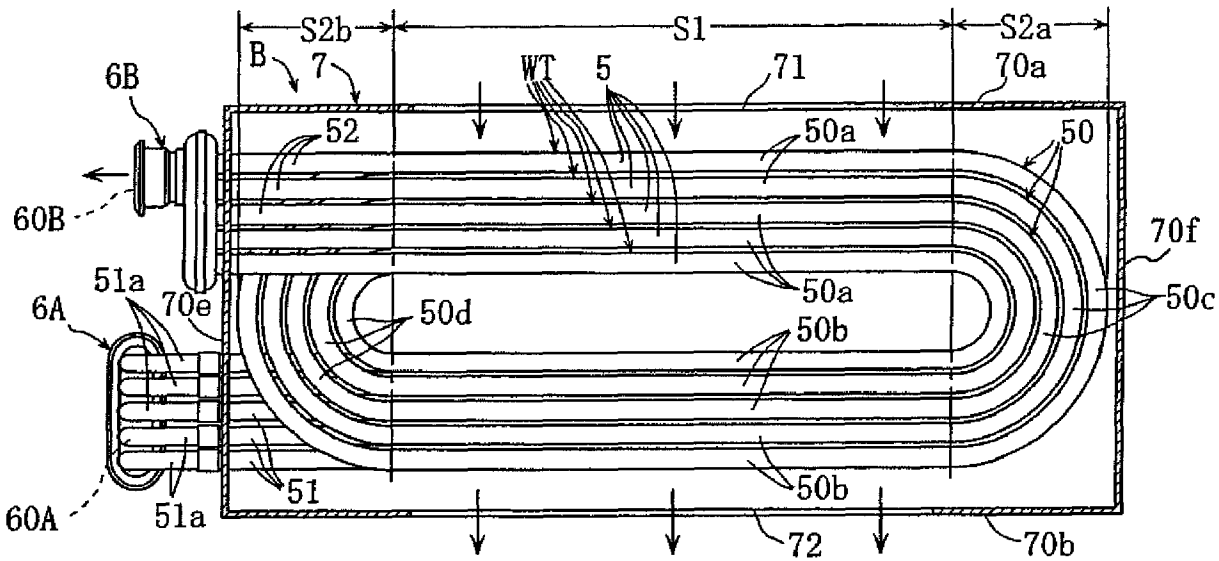
Figure 5B:
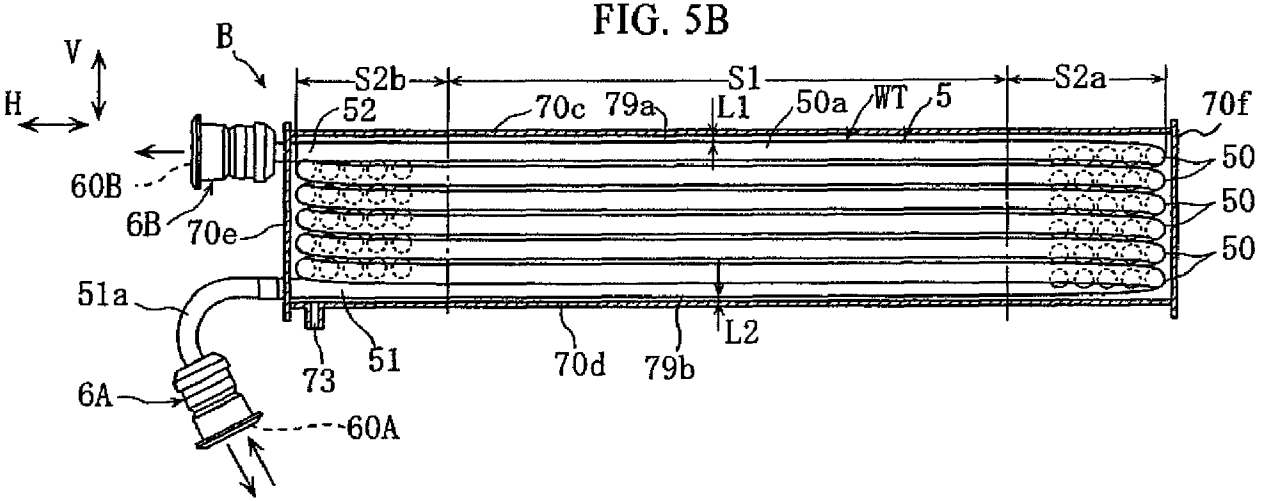
FIG. 5B is a front sectional view thereof.

As shown in FIGS. 5A and 5B, respective helical tube bodies 5 of the plurality of (five, for example) water tubes WT are accommodated in the casing 7. For easier understanding, the structure of a single water tube WT will be described below with reference to FIGS. 6A and 6B. The water tube WT shown in the figures may be formed by bending a single material tube. The water tube WT includes a helical tube body 5, and extensions 51 and 52 integrally connected to a lower end and an upper end of the helical tube body 5. The extensions extend through one of the second pair of opposing side walls, namely side wall 70*e*.

The helical tube body 5 includes a plurality of generally ellipse loops 50 which are arranged in the axial direction of the helical tube body 5 (in the direction in which the central axis C extends) via gaps 59 and continuously connected to each other.

In this embodiment, the axial direction is the vertical direction V. In using the water heater A, the water heater A is so installed at an appropriate position that the axial direction corresponds to the vertical direction. In the width direction (the right and left direction in FIGS. 6A and 6B), each of the loops 50 is made up of an intermediate region S1 and opposite end regions S2*a* and S2*b*. The intermediate region S1 comprises a pair of straight tube portions 50*a* and 50*b* extending in parallel with each other. The straight tube portions 50*a* and 50*b* extend perpendicularly to the axial direction. The straight tube portions 50*a* and 50*b* are non-inclined tube portions which are not inclined with respect to the horizontal surface. The opposite end regions S2*a* and S2*b* comprise generally semicircular or arcuate bent tube portions 50*c* and 50*d*. The bent tube portions 50*c* and 50*d* are inclined tube portions which are inclined with respect to the axial direction and the horizontal surface.

Figure 6A:
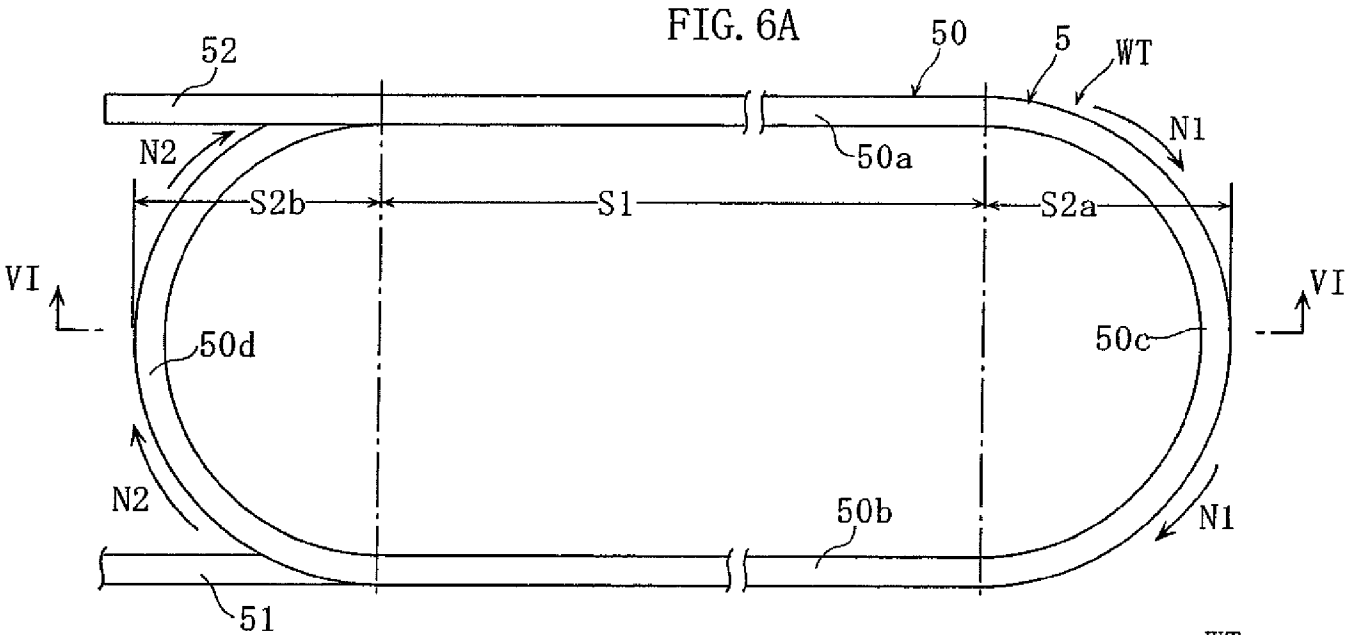
Figure 6B:
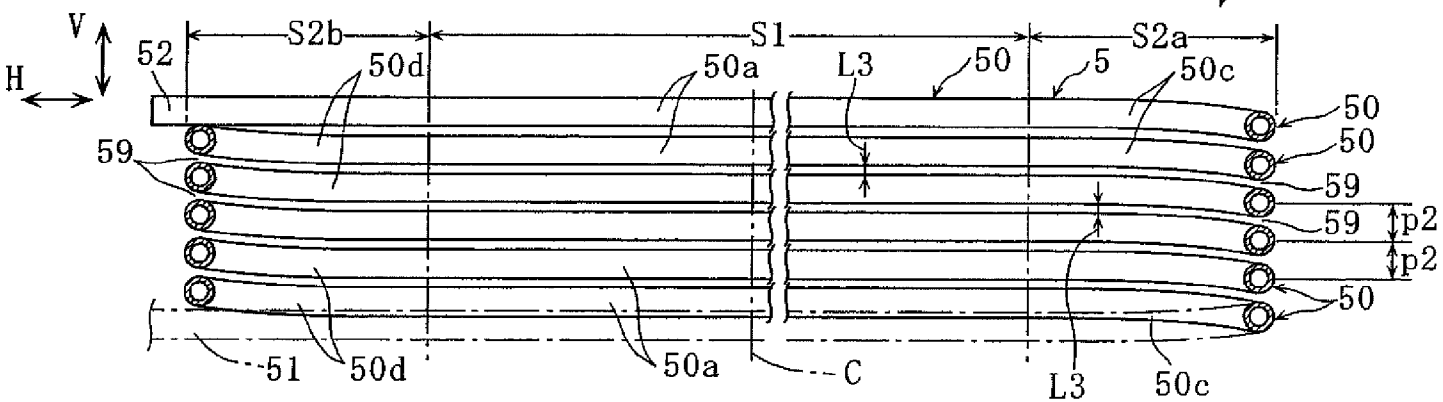
FIG. 6B is a sectional view taken along lines VI-VI in FIG. 6A.

Specifically, in FIG. 6A, the bent tube portion 50*c* is so inclined at an appropriate angle that the height thereof gradually reduces as proceeding from an end of the straight tube portion 50*a* toward an end of the uppermost straight tube portion 50*b* in the direction indicated by the arrow N1. The straight tube portion 50*a* is positioned higher than the straight tube portion 50*b*. The bent tube portion 50*d* is so inclined that the height thereof gradually reduces as proceeding from the other end of the straight tube portion 50*b* toward an end of the straight tube portion 50*a* of the subsequent loop 50 in the direction indicated by the arrow N2. It is to be noted that the straight tube portions 50*a*, 50*b* and the bent tube portions 50*c*, 50*d* of other loops 50 have a structure similar to the above.

As shown in FIGS. 5A and 5B, the helical tube bodies 5 of the plurality of water tubes WT have different sizes and are arranged generally concentrically in the casing 7. The uppermost straight tube portions 50*a*, 50*b* of the helical tube bodies 5 face the inner surface of the upper wall 70*c* of the casing 7 via a gap 79*a* and extend generally in parallel with the inner surface. The lowermost straight tube portions 50*a*, 50*b* of the helical tube bodies 5 face the inner surface of the bottom wall 70*d* of the casing 7 via a gap 79*b* and extend generally in parallel with the inner surface. With this structure, the widths L1 and L2 of the gaps 79*a* and 79*b* are constant.

An end of each of the extensions 51, 52 penetrates through the side wall 70*e* of the casing 7 to be positioned outside the casing 7 and is connected to the water inflow header 6A or the hot-water outflow header 6B. The header 6A includes a port 60A for water inflow, which is utilized as a water discharge port in draining water from the water tubes WT. Each of the extensions 51 is provided with a downwardly bent portion 51*a* positioned outside the casing 7. As will be described later, the bent portion 51*a* is utilized for properly draining water from the water tube WT and may comprise a bent tube formed separately from the extension 51. In this embodiment, the header 6A is slightly inclined with respect to the vertical direction V, so that the port 60A is not oriented vertically downward. This structure is convenient for connecting a pipe 80 for water inflow, for example. However, the header 6A may be oriented in a different way. Unlike the extension 51, each of the extensions 52 is not provided with a part corresponding to the bent portion 51*a* and directly connected to the hot-water outflow header 6B. As shown in FIG. 1, the header 6B includes a port 60B for hot-water outflow, which is connected to a water inlet 11*a* of the primary heat exchanger 1 via a pipe 81. In the primary heat exchanger 1, the water supplied from the secondary heat exchanger B flows through the water tube 11 to be further heated. The water heated in this way is supplied to an appropriate destination through a hot-water outlet 11*b*. However, the order in which water flows through the primary heat exchanger 1 and through the secondary heat exchanger B is not limitative. For instance, water may first be supplied to the primary heat exchanger 1 and then supplied to the secondary heat exchanger B.

The operation and advantages of the secondary heat exchanger B and the water heater A provided with the heat exchanger B will be described below.

In the water heater A shown in FIG. 1, when water is supplied to the water tubes WT of the secondary heat exchanger B and the water tube 11 of the primary heat exchanger 1, the burner 3 starts. Then, from the combustion gas generated by the burner 3, sensible heat and latent heat are recovered by the primary heat exchanger 1 and the secondary heat exchanger B. The hot water generated by the heat recovery is supplied to an appropriate destination through the hot-water outlet 11*b*.

Figure 7:
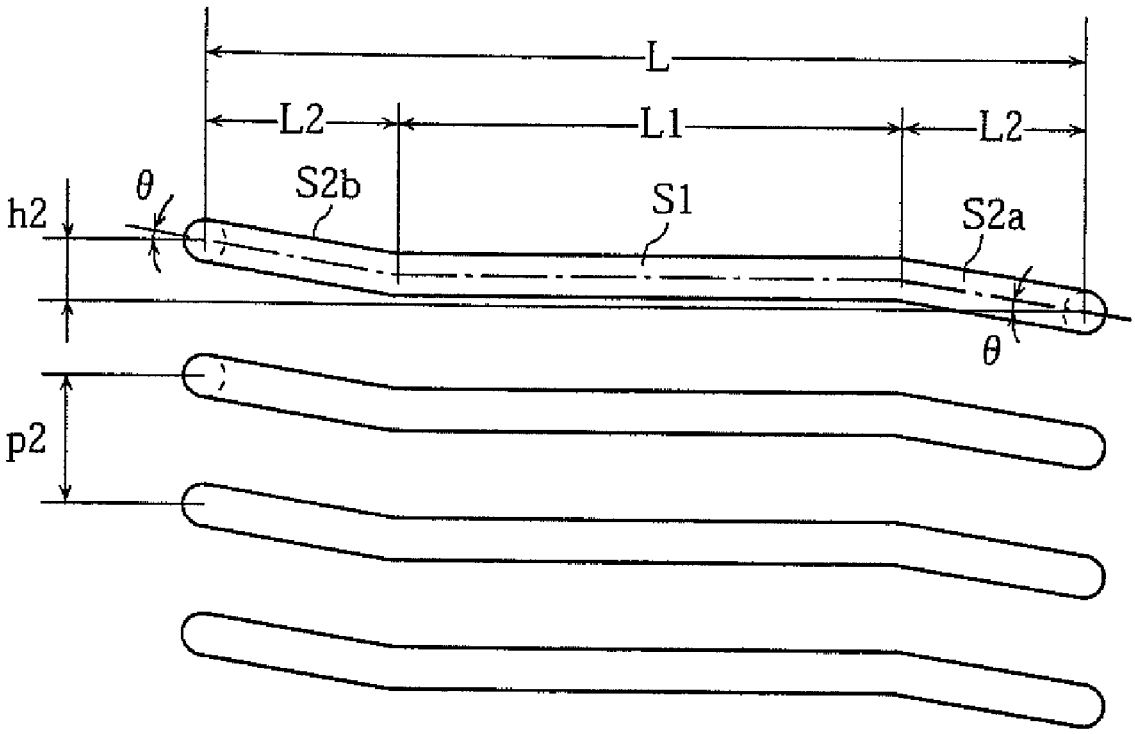
FIG. 7 schematically shows the water tube shown in FIGS. 6A and 6B.

As described before with reference to FIGS. 6A and 6B, in each loop 50 of the water tubes WT, only the opposite end regions S2*a* and S2*b* are inclined with respect to the horizontal surface, and the intermediate region S1 is horizontal. FIG. 7 schematically shows the structure of the loop 50. In this figure, the height h2 of a half region of the loop 50 is given by h2=2•L2• tan •, and the pitch p2 of the helical tube body 5 is given by p2=2•h2=4•L2• tan •, where L is the width of the loop 50, L1 is the width of the intermediate region S1, L2 is the width of the opposite end regions S2*a*, S2*b*, and • is the angle of inclination of the opposite end regions S2*a*, S2*b*. Thus, the pitch p2 is smaller than the pitch p1 of the conventional structure shown in FIG. 1. Specifically, p2 is smaller than p1 by 2•L1• tan •. As will be understood from this, in this embodiment, the pitch of the helical tube body 5 can be reduced. Therefore, even when the number of loops 50 is increased to increase the amount of heat recovery, the overall height of the helical tube body 5 does not become so large, so that considerable increase in size of the secondary heat exchanger B can be properly prevented. Particularly, in this embodiment, the loops 50 have a generally ellipse shape in plan view. Therefore, by elongating the straight tube portions 50*a* and 50*b*, the heat transfer area of the water tube WT can be increased without increasing the height of the helical tube body 5. Therefore, the heat exchange efficiency can be increased without making the secondary heat exchanger B large.

In the secondary heat exchanger B, heat is recovered when combustion gas flows through the gaps 59 defined between the loops 50. Since the loops 50 arranged in the vertical direction V have an almost identical shape, the width (indicated by reference sign L3 in FIG. 6B) of the gap 59 is generally uniform along the longitudinal direction. Therefore, it is possible to prevent the combustion gas from flowing concentratedly through a particular portion due to the non-uniformity of the width of the gap 59. Thus, the combustion gas acts on every portion of each loop 50 generally uniformly. This is also advantageous for increasing the amount of heat recovery and enhancing the heat exchange efficiency.

The combustion gas also flows into the gaps 79*a*, 79*b* defined between the loops 50 and the upper wall 70*c* and the bottom wall 70*d* of the casing 7, and heat is recovered also at the gaps 79*a*, 79*b*. The widths L1, L2 of the gaps 79*a*, 79*b* are uniform at the regions where the straight tube portions 50*a*, 50*b* exist. Therefore, also at the gaps 79*a*, 79*b*, combustion gas can be distributed generally uniformly, so that heat can be recovered efficiently. As would be understood by one of ordinary skill in the art, combustion gas is introduced into the casing through the gas supply port and flows through the gaps between adjacent ones of the loops and across at least the non-inclined portion of each one of the loops and is thereafter discharged from the casing through the gas discharge port.

In winter, for example, the operation of the water heater A may be stopped for a long time. In such a case, to prevent the inside of the primary heat exchanger 1 and the secondary heat exchanger B from freezing, water supply to the water tubes 11 and WT is stopped, and draining is performed. According to this embodiment, water can be prevented from remaining in the water tubes WT of the secondary heat exchanger B, as will be described below.

In the helical tube body 5, the opposite end regions S2*a* and S2*b* of each loop 50 are inclined. Therefore, because of the provision of the inclined end regions S2*a* and S2*b*, water smoothly flows from a higher portion to a lower portion of the helical tube body 5. Further, since the straight tube portions 50*a* and 50*b* of the intermediate region S1 are horizontal, accumulation of water in these portions is properly prevented. Thus, the water in the straight tube portion 50*a* or 50*b* flows to the subsequent loop 50 through the adjacent bent portion 50*c* or 50*d*. In this way, draining of the water tubes WT can be properly performed.

To increase the amount of latent heat recovery, it is preferable that each water tube WT of the secondary heat exchanger B is thinner than that of the water tube 11 of the primary heat exchanger 1. However, when the water tube WT is thin i.e., has a small diameter, a water film may be formed at the end opening of the extension 51 due to the surface tension. Such a water film hinders draining of the water tube WT. In this embodiment, however, the water film can be broken by the pressure head of the water existing in the bent portion 51*a* of the extension 51. Therefore, water can be smoothly discharged from the end opening of the extension 51 toward the header 6A. In this embodiment, the portion of the extension 51 which is closer to the helical tube body 5 than to the bent portion 51*a* is horizontal. In the present invention, however, this portion may be inclined to facilitate the water flow from this portion toward the header 6A.

The present invention is not limited to the foregoing embodiment. The specific structure of each part of the heat exchanger, the water heater and the water tube of the heat exchanger may be varied in design in various ways.

Figure 8:
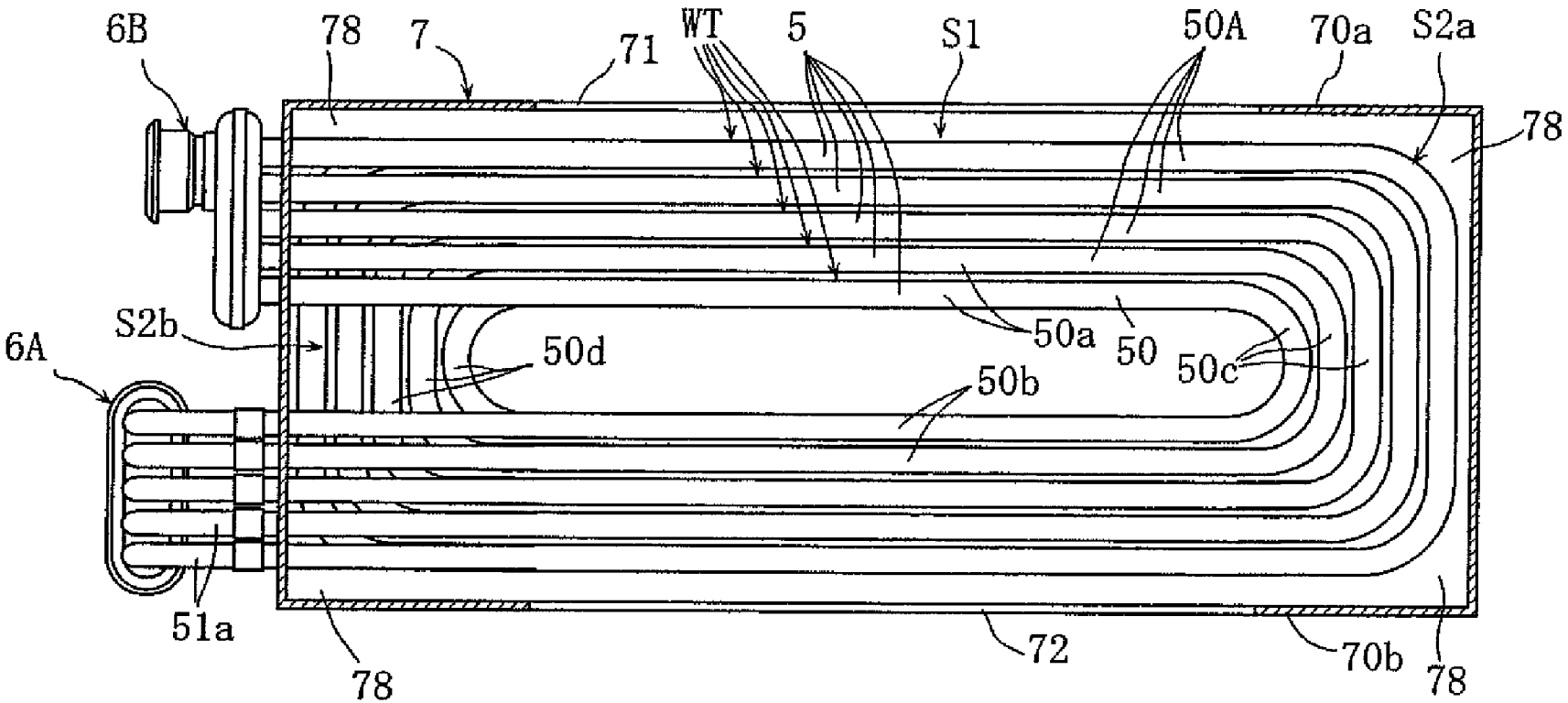
FIG. 8 is a horizontal sectional view showing another example of heat exchanger according to the present invention.
Figure 9:
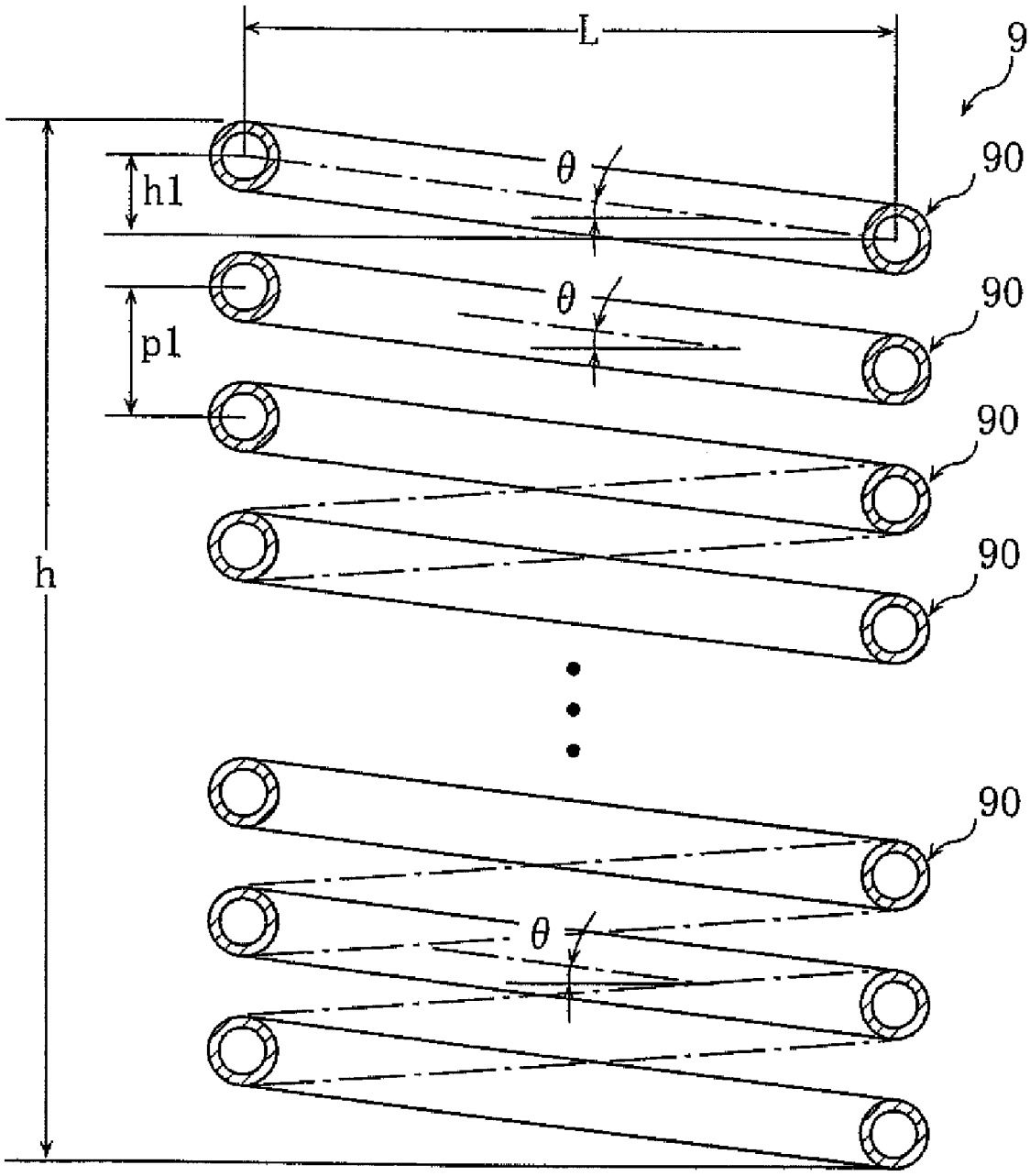
FIG. 9 schematically shows an example of conventional structure.

The loops of the helical tube body of the water tube may not be ellipse in plan view but may have another shape. FIG. 8 shows an example of water tube having a shape different from that of the foregoing embodiment. In this figure, the elements which are identical or similar to those of the foregoing embodiment are designated by the same reference signs as those used for the foregoing embodiment. In the illustrated example, the loop 50 of the innermost water tube WT has a structure similar to that of the foregoing embodiment, i.e., includes opposite end regions S2*a* and S2*b* which are bent to be semicircular or arcuate. However, the loops 50A of the other water tubes WT located outward are generally rectangular in plan view, and the opposite end regions S2*a* and S2*b* thereof are so bent as to include a straight portion, and the radius of curvature of the bent portions is small. With this structure, part of the helical tube body 5 can be arranged at or adjacent to the four corner portions 78 of the casing 7, so that the dead space within the casing 7 can be reduced. In the present invention, the loops may have a shape other than those described above. For example, the loops may have a generally square shape or a generally circular shape.

In the present invention, the number of water tubes is not limitative. Although not very practical, the use of only a single water tube is possible, and the present invention is also applicable to such a structure. Although it is preferable that all the loops of the helical tube body are horizontal at the intermediate region and inclined at opposite end regions, the present invention is not limited to this. In the present invention, only some of the loops may have such a structure. Also in this case, as compared with a conventional structure, the amount of heat recovery can be increased while suppressing an increase in height of the helical tube body. In the present invention, the terms "opposite end regions" and "intermediate region" of the loop in the width direction just indicate the positional relationship between portions of a loop. Therefore, the dimension or dimension ratio of these regions is not limitative.

Although the present invention is not applied to a primary heat exchanger for sensible heat recovery in the foregoing embodiment, the heat exchanger according to the present invention is not limited to a heat exchanger for sensible heat recovery or that for latent heat recovery.

As the burner of the water heater according to the present invention, a burner other than a gas burner may be used, and an oil burner may be used, for example. The system for causing combustion gas to flow into the casing of the heat exchanger and for causing the combustion gas to act on the water tubes is not limited to that of the foregoing embodiment. For example, the combustion gas may be guided to the inside of the helical tube body and caused to flow to the outside of the helical rube body through the gaps between the loops. The water heater in the present invention refers to apparatuses having a function to produce hot water and includes various apparatuses for supplying hot water for general use, use at a bath, space heating or melting snow and so on and apparatuses for producing hot water for the purposes other than the hot water supply.

The invention claimed is:

1. A heat exchanger comprising:

a water tube that comprises a helical tube body, the helical tube body includes a plurality of hollow tubular loops arranged in a vertical direction and connected to each other; and a casing that surrounds periphery of the helical tube body, a combustion gas is configured to be introduced into the casing from a supply port and to be discharged from a discharge port;

wherein each of the loops is in a generally ellipse shape in a plan view or in a generally rectangular shape in a plan view, includes a pair of two straight tube portions extending in a width direction of the casing and includes a pair of two bent tube portions connected to respective ends of the straight tube portions, each of the bent tube portions being generally circular, or a part of the bent tube portion being linear;

wherein the pair of the bent tube portions are formed as inclined tube portions inclining with respect to the horizontal surface and the pair of the straight tube portions are formed as horizontal non-inclined pipe portions;

wherein the heat exchanger comprises at least two helical tube bodies that are arranged generally concentrically with at least an inner helical tube body and an outer helical tube body disposed horizontally apart from and surrounding the inner helical tube body to form a generally-uniform horizontally-extending gap between the inner helical tube body and the outer helical tube body, the straight tube portions are arranged in a front and back directions of the casing, and the bent tube portions are arranged in the width direction of the casing.

2. The heat exchanger according to claim 1, wherein the water tubes comprise an extension connected to lowermost loops of the helical tube bodies, a part of the extension being positioned outside the casing and comprising a bent portion.

3. The heat exchanger according to claim 1, wherein the combustion gas is configured to pass between the loops and through gaps between the water tubes and the casing.

4. A water heater comprising a burner and the heat exchanger according to claim 1.

5. A heat exchanger comprising:

a casing having a combustion gas supply port and a combustion gas discharge port;

a water inflow header and a hot-water outflow header disposed exteriorly of the casing; and a helical tube assembly disposed substantially interiorly of the casing and including at least a first helical tubular body and a second helical tubular body spiraling vertically inside the casing, each one of the first and second helical tubular bodies having a first end in fluid communication with the water inflow header exteriorly of the casing and a second end in fluid communication with the hot-water outflow header exteriorly of the casing, each one of the first and second helical tubular bodies having a plurality straight tube sections and a plurality of bent tube sections interconnecting respective ones of the straight tube sections forming a continuous series of loops, wherein the first tubular body surrounds the second tubular body in a manner that the second tubular body is spaced apart from and positioned adjacent to the first tubular body forming a first gap therebetween such that adjacent ones of the straight tube sections of the first and second tubular bodies are disposed in respective common horizontal planes and adjacent ones of the bent tube sections of the first and second tubular bodies are disposed in respective common inclined planes that extend angularly relative to the common horizontal planes.

6. A heat exchanger according to claim 5, further comprising a third tubular body having a plurality straight tube sections and a plurality of bent tube sections interconnecting respective ones of the straight tube sections forming a continuous series of loops, wherein the second tubular body surrounds the third tubular body in a manner that the third tubular body is spaced apart from and positioned adjacent to the second tubular body forming a second gap therebetween such that adjacent ones of the straight tube sections of the first, second and third tubular bodies are disposed in the respective common horizontal planes and adjacent ones of the bent tube sections of the first, second and third tubular bodies are disposed in the respective common inclined planes.

* * * * *